US011420234B2

(12) United States Patent
Jeindl

(10) Patent No.: US 11,420,234 B2
(45) Date of Patent: Aug. 23, 2022

(54) DEVICE FOR EJECTING BAD PRODUCTS FROM A PRODUCT STREAM

(71) Applicant: Insort GmbH., Kirchberg a.d. Raab (AT)

(72) Inventor: Matthias Jeindl, Gleisdorf (AT)

(73) Assignee: INSORT GMBH, Kirchberg Raab (AT)

( * ) Notice: Subject to any disclaimer, the term of this patent is extended or adjusted under 35 U.S.C. 154(b) by 91 days.

(21) Appl. No.: 16/959,842

(22) PCT Filed: Jan. 4, 2019

(86) PCT No.: PCT/AT2019/060001

§ 371 (c)(1),
(2) Date: Jul. 2, 2020

(87) PCT Pub. No.: WO2019/136503

PCT Pub. Date: Jul. 18, 2019

(65) Prior Publication Data

US 2020/0368788 A1 Nov. 26, 2020

(30) Foreign Application Priority Data

Jan. 10, 2018 (AT) ..... A 50009/2018

(51) Int. Cl.
*B07C 5/36* (2006.01)
*B07C 5/34* (2006.01)
*B07C 5/342* (2006.01)

(52) U.S. Cl.
CPC ..... *B07C 5/368* (2013.01); *B07C 5/342* (2013.01); *B07C 5/3416* (2013.01)

(58) Field of Classification Search
CPC ..... B07C 5/342; B07C 5/368; B07C 5/3416; E01B 27/16
See application file for complete search history.

(56) References Cited

U.S. PATENT DOCUMENTS 5,699,724 A 12/1997 Wettstein et al.
8,247,724 B2 * 8/2012 Mills ..... B65G 11/083 209/576

(Continued)

FOREIGN PATENT DOCUMENTS

DE 19516569 11/1996

OTHER PUBLICATIONS

International Search Report issued in Application No. PCT/AT2019/060001 dated May 28, 2019.

(Continued)

*Primary Examiner* — Michael McCullough
*Assistant Examiner* — Kalyanavenkateshware Kumar
(74) *Attorney, Agent, or Firm* — Workman Nydegger

(57) ABSTRACT

A device for discharging bad products from a product stream, including a detection unit for detecting the product stream and a computer unit for receiving property data of the product stream from the detection unit and for identifying bad products in the product stream. The device includes a compressed air discharge unit controlled by the computer unit and a deflection element discharge unit for the passive discharge of bad products from the product stream. The computer unit divides the identified bad products into first-order and second-order bad products and controls the compressed air discharge unit so that it will actively discharge the first-order bad products, and also controls the deflection element discharge unit so that it will passively discharge the second-order bad products.

13 Claims, 2 Drawing Sheets

(56) References Cited

U.S. PATENT DOCUMENTS

Figure 1:
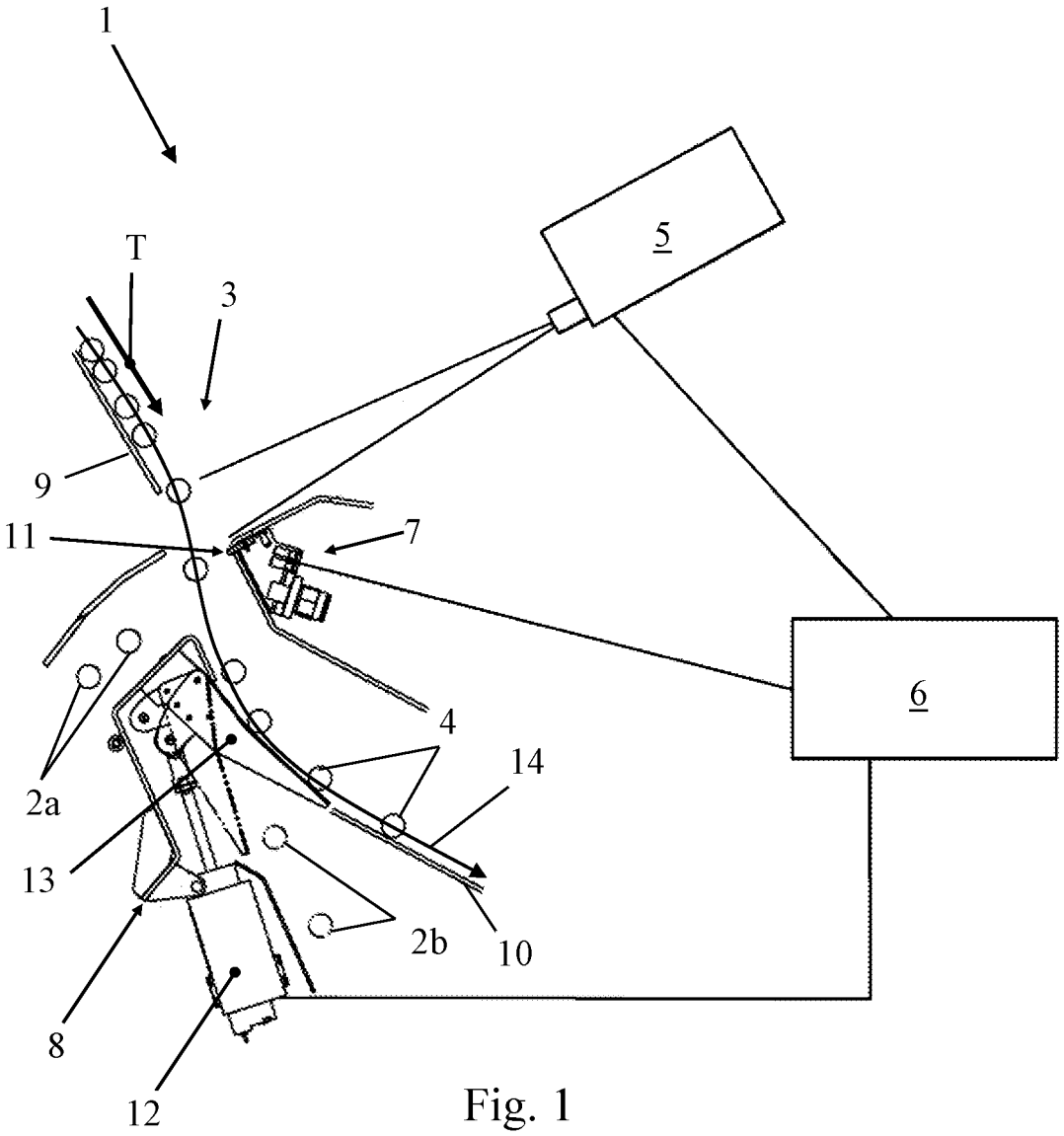

| | | | | |
|---|---|---|---|---|
| 8,662,314 | B2 * | 3/2014 | Jones | B07C 5/363 209/656 |
| 9,939,387 | B2 * | 4/2018 | Okamoto | G01N 21/95 |
| 2002/0008056 | A1 | 1/2002 | Satake et al. | |
| 2010/0236994 | A1 | 9/2010 | Hoffman et al. | |
| 2018/0027848 | A1 * | 2/2018 | Blaine | A22C 17/0086 |

OTHER PUBLICATIONS

International Preliminary Report on Patentability issued in Application No. PCT/AT2019/060001 dated Oct. 18, 2019.

* cited by examiner

DEVICE FOR EJECTING BAD PRODUCTS FROM A PRODUCT STREAM

The present application is a U.S. National Stage of International Application No. PCT/AT2019/060001, filed on Jan. 4, 2019, designating the United States and claiming the priority of Austrian Patent Application No. A 500009/2018 filed with the Austrian Patent Office on Jan. 10, 2018. All of the aforementioned applications are incorporated herein in their respective entireties by this reference.

The invention relates to a device for discharging bad products from a product stream made up of good products and bad products and moving in a transport direction according to the preamble of claim 1.

From the U.S. Pat. No. 9,452,450 B2, a device for discharging bad products from a product stream made up of good products and bad products and moving in a transport direction is known, which comprises an optical detection unit, a computer unit, a first discharge unit formed by a compressed air unit and a second discharge unit formed by a controllable mechanical lever. The optical detection unit, the computer unit, the first and the second discharge units are interconnected for the exchange of data. The first and the second discharge units are arranged at the product stream in the transport direction downstream of the optical detection unit. The first discharge unit and the second discharge unit are arranged adjacent to each another on the same side of the product stream, with the first discharge unit being arranged in the transport direction upstream of the second discharge unit. The optical detection unit detects the product stream and continuously transmits the resultant optical data to the computer unit. The computer unit processes the optical data, identifies bad products in the product stream in real time and controls the compressed air unit and/or the mechanical lever to discharge the bad products from the product stream. Such a device is used, for example, for sorting out fruit or vegetables. The U.S. Pat. No. 9,452,450 B2 was published also as EP 2 396 124 B1.

However, this known device has turned out to be associated with the disadvantage that, due to the arrangement of the first and the second discharge units directly next to each other on the same side of the product stream and the resulting narrow spatial conditions, the discharge units may only have a small size. However, the small feasible size of the discharge units leads to the disadvantage that, particularly in case of very small and very large heavy-weight products, the performance of the discharge units is too low for discharging bad products from the product stream, both in terms of the mass that can be discharged and in terms of speed. Actually, there would be the possibility of increasing the distance between the discharge units, but this would lead to an undesirable lengthening of the device, whereby the use of such a device in a higher-level system, for example, a washing, sorting and packaging facility, would not be possible due to limited installation requirements. In addition, the maintenance of the discharge units is hampered by the closely spaced discharge units, as they are difficult to access.

Another problem with sorting devices is that the bad products can have a wide variety of shapes, dimensions and weights and, therefore, it is difficult, often even impossible, to design discharge units suitable for discharging all bad products which, in practice, occur in a product stream.

It is thus the object of the present invention to provide a device for discharging bad products from a product stream, which overcomes the disadvantages of the prior art and improves a discharge quality.

According to the invention, the above-mentioned object is achieved by a device having the features of claim 1. Preferred embodiments of the invention are a subject-matter of the dependent claims.

In the device according to the invention, a compressed air discharge unit and a deflection element discharge unit are arranged on opposite sides of the product stream. This results in the advantage that more installation space will be available for the discharge units and, despite this, the device will not be lengthened. Consequently, the discharge units can be constructed so as to be more powerful, which means that also very small and very large heavy-weight products can reliably be discharged from the product stream. In addition, the arrangement of the discharge units on opposite sides of the product stream improves the accessibility of the discharge units, whereby they can be maintained better and more easily. A particularly important advantage of the invention is that a higher precision of discharge is achieved. That is to say, the closer to the line of sight of the detection unit the discharge units can be installed, the better will be the precision of discharge, since the accuracy regarding bad products in the material flow will be increased and over-sorting, which is the undesirable discharge of good products together with bad products, will be reduced. Only by arranging the discharge units on opposite sides of the material flow, it is possible to arrange the discharge units closely enough to the line of sight, thus achieving the increased precision of discharge.

By combining the compressed air discharge unit and the deflection element discharge unit, the system-related disadvantages of the respective type of discharge can be overcome and the respective system-related advantages can be utilized synergetically in an optimum way. In this context, the compressed air discharge unit is used advantageously for small-sized bad products, which can be deflected precisely by an air flow. Such bad products are characterized in particular by a low mass with a comparatively small surface area or a small surface area with a comparatively small mass.

Bad products which do not meet those criteria and have a high mass with a comparatively small surface area or a large surface area with a comparatively small mass are discharged with the deflection element discharge unit, wherein, according to the invention, the deflection element discharge unit has at least one actuator which moves the at least one deflection element between a first position and a second position, with the deflection element protruding into the product stream in the first position and being arranged outside of the product stream in the second position, with the good products being deflected in the first position. Such a device is referred to as a passive system as it deflects the good product from the product stream, whereas the bad product is not influenced in its path in the product stream by the deflection elements. This passive system has the advantage that the discharge units and the associated control can be optimized for the good product, which usually is known in terms of shape and weight. By contrast, the bad product may consist of very different products, which would render an optimization of the deflection elements considerably more difficult, but is not necessary according to the invention, since the bad product does not come into contact with the deflection elements. As a result, bad products which cannot be discharged with the compressed air discharge unit are discharged passively with the deflection element discharge unit. The quality of the discharge is thereby improved, since fewer bad products will remain in the product stream than in conventional sorting systems and oversorting will be minimized.

A sorting system is known from the document US 2010/236994 A1 which, unlike the passive discharge of external products from a product stream according to the invention, relies on the active discharge of external products from a product stream. As an active discharge, a system is defined in which the bad product is deflected from its trajectory by the discharge units in such a way that it is removed from the product stream and conveyed into a separate path. The good product, however, is not influenced in its path by the discharge units. Until the present invention, the industry generally used an active discharge of external products, since it was assumed among experts that oversorting would be largely avoided in this way. The inventors of the present application deserve credit for having realized, contrary to the generally prevalent opinion among experts, that by implementing a passive discharge, advantages can be obtained with regard to product safety, i.e., reliability in sorting out foreign materials and bad products, which far outweigh the disadvantages of a possible oversorting. For example, the risk that foreign materials cannot be removed from the product stream and therefore end up with the consumer, causing expensive recall campaigns, is minimized by the device according to the invention.

In a preferred embodiment of the invention, the deflection element discharge unit—as seen in the transport direction—is arranged downstream of the detection unit on the product stream and is designed for discharging bad products by partially deflecting the product stream by means of at least one deflection element. In an alternative embodiment, the order of the discharge units is reversed, i.e., the deflection element discharge unit is arranged in the transport direction upstream of the compressed air discharge unit.

In the discharge of bad products, the deflection element discharge unit provides a high degree of discharge safety due to the simple deflection of the bad products from the product stream also regardless of their size, material and shape, but has the disadvantage that, per discharge of bad products, also products which are not intended for discharge, i.e., good products, are discharged as well and, therefore, oversorting occurs.

The classification of the bad products is done by the computer unit, wherein the computer unit divides the bad products into first-order bad products, which can be discharged readily by means of an air flow, and second-order bad products, which are the remaining bad products. The first-order bad products are discharged by the compressed air discharge unit, while being controlled by the computer unit, and the second-order bad products are discharged by the deflection element discharge unit, while being controlled by the computer unit.

Advantageously, a distinction is made by the computer unit between good products, first-order bad products and second-order bad products, based on at least one of the following features:

- the colour of the products contained in the product stream;
- outlines and shapes, in particular the size and form, of the products contained in the product stream;
- differences in reflection or transmission spectra under irradiation with electromagnetic waves from the entire electromagnetic spectrum or parts thereof, preferably X-rays, infrared radiation, terahertz radiation;
- differences in the electrical conductivity or in the magnetizability of the product stream Accordingly, at least one detection unit is preferably designed for detecting the above-mentioned features and for outputting corresponding property data. To be more precise, in a preferred embodiment, the detection unit is designed for detecting at least a subrange of a reflection or transmission spectrum when the products are irradiated with electromagnetic waves. The subrange of the reflection or transmission spectrum can, on the one hand, be light in the visible wavelength range or outside of the visible wavelength range, but also other electromagnetic waves, such as, e.g., X-rays or terahertz radiation (microwave radiation).

If the computer unit is designed for determining both the outlines or shapes of the products contained in the product stream and the spectral composition of the products contained in the product stream from the property data of the product stream, the computer unit advantageously determines the material of the products from the spectral composition of the products contained in the product stream and the volume of the products from the outlines or the shape of the products in order to estimate the mass of the products from their material and volume and to differentiate between good products, first-order bad products and second-order bad products, based on the mass of the products.

If the detection unit is designed as an optical detection unit for detecting light in the visible wavelength range and/or outside of the visible wavelength range, it preferably comprises a hyperspectral camera and/or an RGB camera and/or a laser system. By using a combination of a hyperspectral camera, an RGB camera and a laser system as the optical detection system, a high accuracy of differentiation between good products, first-order bad products and second-order bad products can be achieved, since a variety of properties of the products in the product stream can be detected with those optical systems. The use of a hyperspectral camera is preferred, since it disintegrates a spectrum into individual narrow frequency bands with high precision, thereby permitting a very fine differentiation of materials. If a hyperspectral camera (also) operating in the near infrared range is used, a further improvement of the material differentiation is enabled, since many materials have characteristic frequency bands in the near infrared range. Through the optional combined use of a hyperspectral camera with an RGB camera and/or a laser system, the distinguishability of materials can be further improved.

The device according to the invention advantageously comprises at least one further detection unit, the further detection unit being arranged on the side of the product stream opposite to the first detection unit. This has the advantage that the product stream can be detected even better, whereby the computer unit can differentiate even better between good products, first-order bad products and second-order bad products, and the quality of the discharge can thus be enhanced even further. The cameras can also be arranged three-dimensionally, i.e., looking at the material flow from different spatial directions.

Advantageous embodiments of the device according to the invention are explained in further detail hereinbelow by way of example with reference to the drawings.

Figure 2:
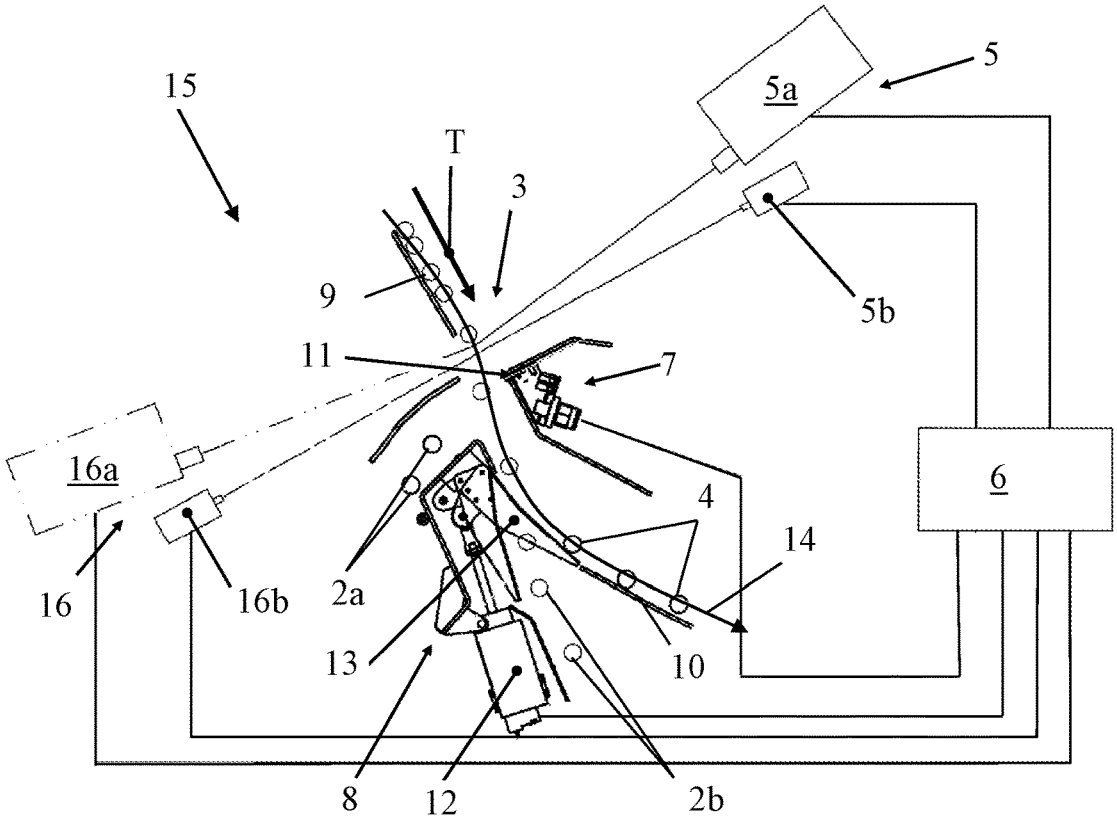
Figure 3:
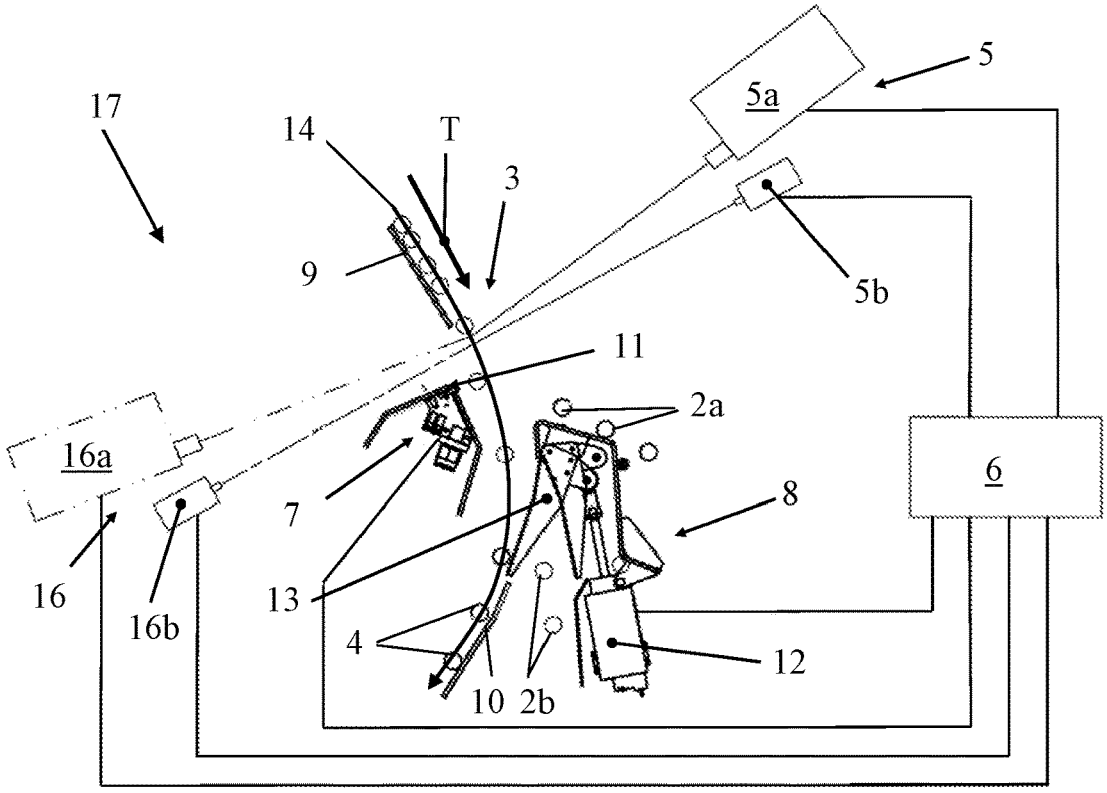

FIGS. 1 to 3 show schematic views of embodiments of a device according to the invention for discharging bad products from a product stream moving in a transport direction.

FIG. 1 shows a schematic view of an embodiment of a device 1 according to the invention for discharging bad products 2*a* and 2*b* from a product stream 3 moving in a transport direction T, the product stream 3 being composed of good products 4 and bad products 2*a* and 2*b*. A subsection of the product stream 3 is depicted in FIG. 1, wherein the product stream 3 moves through the device 1 along a path 14 and is guided by baffles 9 and 10 in two sections.

The device 1 comprises a detection unit 5, a computer unit 6, a first discharge unit 7 and a second discharge unit 8, which are interconnected for the exchange of data. In the embodiment shown in FIG. 1, the second discharge unit 8 is arranged at the product stream 3 in the transport direction T downstream of the first discharge unit 7 and the first discharge unit 7 and the second discharge unit 8 are arranged opposite to each other on the product stream 3. However, there is also the possibility that the second discharge unit 8 is arranged at the product stream 3 in the transport direction T upstream of the first discharge unit 7. The arrangement of the first discharge unit 7 and the second discharge unit 8 is advantageously adapted to the installation requirements of the device 1 in higher-level systems and/or of the transport direction T of the product stream 3 and the path 14 resulting therefrom.

The first discharge unit 7 is designed for discharging first-order bad products 2*a*. The first discharge unit 7 is formed by a compressed air unit which has a nozzle 11 with a valve that can be controlled electrically by the computer unit. The compressed air unit is connected to a compressed air supply via supply lines, which are not illustrated. The first discharge unit 7 thus constitutes a compressed air discharge unit. In the embodiment variant of the device 1 according to the invention as shown in FIG. 1, only a first discharge unit 7 is illustrated, but the device 1 can also have a plurality of first discharge units 7, which may be arranged either consecutively, side by side or offset from each other. There is also the possibility that the compressed air unit comprises a control valve designed for adjusting an intensity of a burst of compressed air emitted from the nozzle 11. The adjustment of the intensity can be effected either manually or via the computer unit 6. If the intensity is adjusted via the computer unit 6, the intensity is advantageously adapted to the first-order bad products 2*a* to be discharged. For example, the intensity can thus be higher in a first-order bad product 2*a* with a high mass and a small dimension than in a first-order bad product 2*a* with a low mass and a small dimension.

The second discharge unit 8 is designed for discharging second-order bad products 2*b*. The second discharge unit 8 is formed by an actuator, e.g., in the form of an electrically controllable pneumatic cylinder 12, and a deflection element 13, with the pneumatic cylinder 12 acting on the deflection element 13, moving it between a first position and a second position. The second discharge unit 8 thus constitutes a deflection element discharge unit. The pneumatic cylinder 12 is connected to a compressed air supply via supply lines, which are not illustrated. In the first position, the deflection element 13 protrudes into the product stream 3 and deflects it, and in the second position, the deflection element 13 is arranged outside of the product stream 3. In the embodiment variant shown in FIG. 1, the pneumatic cylinder 12 is controlled by the computer unit 6 in such a way that the good products 4 are deflected in the first position and the second-order bad products 2*b* are discharged in the second position. Such a discharge, which discharges the second-order bad products 2*b* without touching them, is also referred to as a passive discharge.

As an active discharge, a system is defined in which the bad product is deflected from its trajectory by the discharge units in such a way that it is removed from the product stream and conveyed into a separate path. The good product, however, is not influenced in its trajectory by the discharge units. Such an active discharge takes place only in the first discharge unit 7 by means of compressed air.

During the passive discharge implemented in the second discharge unit 8, the good product is deflected, whereas the bad product is not influenced in its trajectory. This passive system has the advantage that the discharge units and the associated control can be optimized for the good product, which usually is known in terms of shape and weight. The bad product may consist of very different products, which would render an optimization considerably more difficult. Since the trajectory of the bad product is not affected, foreign materials, such as, e.g., rubber balls, are also removed more safely, because, during the deflection in an active system, uncontrolled movements of elastic products, e.g., uncontrolled bouncing of the rubber ball, may easily occur in the plant, whereby the ball can ultimately end up back in the good product. The same applies also to extremely light-weight or, respectively, floating bad products, such as, for example, film or paper. The system provides further advantages, for example, also for glass, as it can be discharged without splinters.

Instead of electrically controllable pneumatic cylinders, other actuators may also be used. Such actuators are known to the person skilled in the art, and he or she knows how to select them according to the intended application. The demands made on the actuators are such they can be used in the system quickly enough, with sufficient accuracy and with great reliability. Examples of such alternative actuators are hydraulic cylinders, solenoids, electric drives, in particular rotary or linear drives.

For certain applications, in particular if the shapes, dimensions and weights of bad products are within narrow tolerances, there is also the possibility that the second discharge unit 8, depending on the nature of the products, is designed as a switch point which actively deflects the good products 4 toward a first discharge path and actively deflects the second-order bad products 2*b* toward a second discharge path, thus discharging them. Furthermore, there is the possibility that the second discharge unit has more than two positions and, hence, a multiway sorting can be performed with this discharge unit alone. (For example: subdivision of good products into several classes by deflection into different discharge paths and passive discharge of bad products).

In this embodiment, the detection unit 5 is designed as an optical detection unit and comprises a hyperspectral camera and, optionally, an RGB camera or a laser system. However, instead of optical detection units, the above-mentioned alternative detection units are also usable.

When the device 1 according to the invention is used, the product stream 3 is guided through the device 1 in the transport direction T along the path 14. In doing so, the product stream 3 is detected with the optical detection unit 5, wherein the optical property data resulting therefrom are continuously transmitted to the computer unit 6.

The optical properties include the spectral composition, the size, the shape and the colour of the products contained in the product stream 3, the computer unit 6 being designed for classifying the products according to their different chemical compositions, based on the spectral composition of the products. Based on the detected size, shape and colour, the computer unit is able to refine the classification and, for example, to differentiate wood residues from skin residues. On the basis of this classification, the computer unit 6 identifies good products 4 as well as bad products 2*a* and 2*b* in the product stream 3 in real time, wherein the computer unit 6 divides the bad products 2*a* and 2*b* into first-order bad products 2*a* and second-order bad products 2*b*, in accordance with the better discharge method.

Based on the ascertained good products 4, first-order bad products 2*a* and second-order bad products 2*b*, the computer unit 6 controls the first discharge unit 7 in a further step so that it will actively discharge the first-order bad products 2*a*, and controls the second discharge unit 8 so that it will passively discharge the second-order bad products 2*b*, whereby only the good products 4 will remain at the end of the path 14.

FIG. 2 shows a schematic view of a further embodiment of a device 15 according to the invention for discharging bad products 2*a* and 2*b* from a product stream 3 moving in a transport direction T. In contrast to the device 1 according to FIG. 1, in the device 15, the detection unit 5 is split into two housings, with, for example, a hyperspectral camera and an RGB camera being accommodated in the housing 5*a* and a laser system being accommodated in the housing 5*b*. Furthermore, the device 15 has an additional detection unit 16 in comparison to the device 1 according to FIG. 1, which is arranged on the side of the product stream 3 opposite to the detection unit 5 and which is also split into two housings, with, for example, a hyperspectral camera and an RGB camera being accommodated in the housing 16*a* and a laser system being accommodated in the housing 5*b*. It should be mentioned that, instead of or in addition to optical sensors, the detection units 5, 16 may also have other sensors, in particular sensors for detecting electromagnetic waves outside of the wavelength range of light, e.g., for the detection of X-rays or terahertz radiation. Due to the additional detection unit 16, the advantage is obtained that the product stream 3 can be detected even more precisely, as a result of which the computer unit 6 is able to differentiate even better between the good product 4, the first-order bad product 2*a* and the second-order bad product 2*b*, and thus the quality of the discharge is enhanced even further. Elements which are the same as in the device 1 according to FIG. 1 are provided with the same reference symbols. Furthermore, it should be pointed out that, in other embodiments of the invention, the above-described arrangement of the detection units 5, 16 can be varied in different housings on different sides of the product stream. For example, adjacent arrangements or an arrangement surrounding the product stream may also be chosen, or, respectively, more than two bad product streams may also be chosen in an unlimited manner.

It should be mentioned that, in the device 15, the discharge of the second-order bad products 2*b* by means of the second discharge unit 8 is a passive discharge. This means that the good products 4 are deflected in the first position of the deflection element 13, whereas, in the second position of the deflection element 13, the second-order bad products 2*b* are discharged from the product stream 3.

FIG. 3 shows a schematic view of a further embodiment of a device 17 according to the invention for discharging bad products 2*a* and 2*b* from a product stream 3 moving in the transport direction T. In contrast to the device 15 according to FIG. 2, the position of the discharge units 7 and 8 relative to the product stream 3 is reversed in the device 17.

Elements of the device 17 which are the same as in the device 15 according to FIG. 2 are provided with the same reference symbols.

The invention claimed is:

1. A device for discharging bad products from a product stream made up of good products and bad products and moving in a transport direction (T), comprising;

a detection unit designed for detecting the product stream, a computer unit connected to the detection unit and operable to receive property data of the product stream from the detection unit and to identify bad products in the product stream detected by the detection unit from the property data in real time, and a discharge unit controlled by the computer unit and—as seen in the transport direction (T)—arranged at the product stream downstream of the detection unit and operable to discharge bad products from the product stream by at least one burst of compressed air, wherein the device comprises at least one further discharge unit controlled by the computer unit and—as seen in the transport direction—arranged at the product stream downstream of the detection unit on the side of the product stream opposite of the compressed air discharge unit and operable to discharge bad products by partially deflecting the product stream by at least one deflection element and the computer unit is operable to divide the identified bad products into first-order bad products and second-order bad products, wherein the compressed air discharge unit is operable to discharge the first-order bad products while being controlled by the computer unit, and the deflection element discharge unit is operable to discharge the second-order bad products while being controlled by the computer unit, wherein the deflection element discharge unit has at least one actuator which moves the at least one deflection element between a first position and a second position, wherein the deflection element protrudes into the product stream in the first position and is arranged outside of the product stream in the second position, with the good products being deflected in the first position, and wherein the computer unit is operable:

to determine the outlines or shapes of the products contained in the product stream and the spectral composition of the products contained in the product stream from the property data of the product stream;

to infer the material of the products from the spectral composition of the products contained in the product stream;

to infer the volume of the products from the outlines or the shape of the products;

to estimate the mass of the products from their material and volume; and to distinguish between good products, first-order bad products, and second-order bad products based on the mass of the products.

2. A device according to claim 1, wherein the deflection element discharge unit is arranged in the transport direction (T) downstream of the compressed air discharge unit.

3. A device according to claim 1, wherein the deflection element discharge unit is arranged in the transport direction upstream of the compressed air discharge unit.

4. A device according to claim 1, wherein the detection unit is operable to detect at least a subrange of a reflection or transmission spectrum when the products are irradiated with electromagnetic waves and for outputting corresponding property data.

5. A device according to claim 4, wherein the detection unit is comprises an optical detection unit operable to detect light in the visible wavelength range and/or outside of the visible wavelength range.

6. A device according to claim 5, wherein the optical detection unit comprises a hyperspectral camera operable to disintegrate frequencies in the near infrared wavelength range and/or in the visible wavelength range.

7. A device according to claim 5, wherein the optical detection unit comprises an RGB camera or a laser system.

8. A device according to claim 4, wherein the detection unit comprises a detection unit operable to detect X-rays or terahertz radiation.

9. A device according to claim 1, wherein the compressed air discharge unit comprises a control valve operable to adjust an intensity of the at least one burst of compressed air.

10. A device according to claim 1, wherein the deflection element deflects the product stream toward a first discharge path in the first position and deflects the product stream toward a second discharge path in the second position.

11. A device according to claim 10, wherein the deflection element is adjustable in further positions for the formation of further discharge paths.

12. A device according to claim 1, wherein the computer unit is operable to determine the colors of the products contained in the product stream from the property data of the product stream, and to distinguish between good products, first-order bad products, and second-order bad products based on the colors of the products.

13. A device according to claim 1, wherein the device comprises a further detection unit.

* * * * *